US007360521B2

(12) United States Patent
Raether

(10) Patent No.: US 7,360,521 B2
(45) Date of Patent: Apr. 22, 2008

(54) RECIPROCATING ENGINES

(75) Inventor: Bradley Lynn Raether, Redmond, OR (US)

(73) Assignee: WaveTech Engines, Inc., Redmond, OR (US)

( * ) Notice: Subject to any disclaimer, the term of this patent is extended or adjusted under 35 U.S.C. 154(b) by 0 days.

(21) Appl. No.: 11/544,817

(22) Filed: Oct. 7, 2006

(65) Prior Publication Data

US 2007/0079791 A1 Apr. 12, 2007

Related U.S. Application Data

(60) Provisional application No. 60/724,390, filed on Oct. 7, 2005.

(51) Int. Cl.
*F02B 75/32* (2006.01)

(52) U.S. Cl. ..... 123/197.1; 74/25

(58) Field of Classification Search ..... 123/197.1; 74/25

See application file for complete search history.

(56) References Cited

U.S. PATENT DOCUMENTS

| | | | | |
|---|---|---|---|---|
| 1,232,202 | A | | 7/1917 | Brown |
| 1,569,525 | A | | 1/1926 | Owens |
| 1,572,068 | A | | 2/1926 | Gould |
| 1,802,902 | A | | 4/1931 | Brau |
| 1,876,506 | A | | 9/1932 | Lee |
| 2,262,963 | A | * | 11/1941 | Procissi ..... 74/58 |
| 2,301,175 | A | | 11/1942 | Earnshaw et al. |
| 2,401,466 | A | | 6/1946 | Davis et al. |
| 3,385,051 | A | | 5/1968 | Kelly |
| 3,388,603 | A | | 6/1968 | Clark |
| 3,598,094 | A | | 8/1971 | Odawara |
| 3,757,748 | A | | 9/1973 | Arney |
| 3,869,928 | A | | 3/1975 | Ishii |
| 3,916,866 | A | | 11/1975 | Rossi |
| 4,180,028 | A | | 12/1979 | Richter |
| 4,210,063 | A | | 7/1980 | Grossman |
| 4,648,285 | A | | 3/1987 | Carson |
| 4,834,033 | A | | 5/1989 | Larsen |
| 4,996,953 | A | | 3/1991 | Buck |
| 5,218,933 | A | | 6/1993 | Ehrlich |
| 5,442,913 | A | | 8/1995 | Cho et al. |
| 5,467,684 | A | | 11/1995 | Sher |
| 5,533,335 | A | | 7/1996 | Shin |

(Continued)

FOREIGN PATENT DOCUMENTS

JP 2007100717 4/2007

*Primary Examiner*—Noah P. Kamen
(74) *Attorney, Agent, or Firm*—Kolisch Hartwell, P.C.

(57) ABSTRACT

Reciprocating engine construction wherein a rotating assembly converts the linear motion of the piston into rotational motion more efficiently, therefore yielding more torque and working power while using less fuel. The rotating assembly is three components working together, an interchanger unit with track rollers mounted at both ends and attached at it's center to the connecting rod by bearings allowing it to rotate while reciprocating, a stationary cylindrical unit having opposing wave shaped races (tracks) encircling it's perimeter with slopes of at least 45 degrees to convert the reciprocating motion to rotational motion on a one to one ratio 90 degrees perpendicular to the axis of the interchanger as the track rollers follow the slopes of the races, a rotating carrier that keeps the track rollers aligned and transfers the converted rotational motion to the output shaft by means of gears.

5 Claims, 12 Drawing Sheets

U.S. PATENT DOCUMENTS

| | | | |
|---|---|---|---|
| 5,592,866 | A | 1/1997 | Sher |
| 5,762,480 | A | 6/1998 | Adahan |
| 5,806,404 | A | 9/1998 | Sher |
| 5,894,820 | A | 4/1999 | Baeta |
| 5,938,224 | A | 8/1999 | Brackett |
| 6,510,831 | B2 | 1/2003 | Wiseman |
| 6,629,589 | B2 | 10/2003 | Inoue |
| 6,701,709 | B2 | 3/2004 | Isaac, Jr. et al. |
| 6,837,141 | B1 | 1/2005 | Edelson |
| 6,889,795 | B2 | 5/2005 | Shibata et al. |
| 6,892,538 | B2 | 5/2005 | Park |
| 7,124,716 | B2 | 10/2006 | Novotny |
| 7,152,556 | B2 | 12/2006 | Goltsman |
| 7,155,830 | B2 | 1/2007 | Sasaki et al. |
| 7,219,631 | B1 | 5/2007 | O'Neill |
| 2002/0056601 | A1 | 5/2002 | Inoue |
| 2003/0056611 | A1 | 3/2003 | Moreno-Aparicio |
| 2003/0089109 | A1 | 5/2003 | Park |
| 2004/0094352 | A1 | 5/2004 | Shibata et al. |
| 2004/0149122 | A1 | 8/2004 | Vaughan et al. |
| 2006/0005649 | A1 | 1/2006 | Baldascini et al. |
| 2007/0137614 | A1 | 6/2007 | Tsuzuki |

* cited by examiner

RECIPROCATING ENGINES

RELATED APPLICATION

This application is based upon and claims priority under 35 U.S.C. § 119(e) to U.S. Provisional Application Ser. No. 60/724,390, entitled "WAVETECH COMBUSTION ENGINE," filed on Oct. 7, 2005.

BACKGROUND OF THE INVENTION

This application concerns improvements in reciprocating engines of spark ignition, compression ignition, or other means of providing pressure to the piston and in particular concerns novel configuration of and physical relationship between the piston and output shaft (crankshaft) through a rotating assembly that more efficiently converts the linear motion of the piston to circular motion, therefore yielding an increased amount of working power from less fuel.

Reciprocating engines have long been known and widely used. Reciprocating engines using internal combustion cycles of various types go back to before the turn of the last century. Today the most common form of reciprocating engines is the internal combustion engine also often known as a piston engine that uses one or more pistons to convert pressure into a rotating motion. Today most reciprocating engines use one of three types of internal combustion cycles, the Otto cycle (four stroke cycle), Diesel cycle or two stroke cycle which uses the combustion of petrol, alcohol, diesel fuel, oil or gaseous type fuels inside the cylinder to provide pressure to the pistons. Reciprocating engines that are powered by pressurized fluid, compressed air, steam or other hot gasses are also still used in some applications today. Though reciprocating engines have achieved considerable popularity and commercial success, there has been a continuing need to increase the efficiency of engines to produce more working power from less fuel.

SUMMARY OF THE INVENTION

Wavetech Engine

The invention may, in its broad sense, be defined as improvements in a reciprocating engine having a block forming a housing for a piston operating in a cylinder (or multiple pistons in cylinders), a rotating assembly for each piston to more efficiently convert the linear motion of the piston(s) into rotational motion to an output shaft (crankshaft) utilizing gears instead of throws, a lubrication system, a head (or multiple heads) forming the top of the combustion chamber(s) and a housing for automotive style intake and exhaust valves as part of a fuel delivery and exhaust system and spark plugs controlled by a spark ignition system or glow plugs in a diesel cycle engine. The improved structure concerns a novel design for a rotating assembly composed of three components cooperating together, an interchanger unit that reciprocates with the piston and rotates at the same time, a cylindrical unit mounted stationary to the engine block having opposing wave shaped races (tracks) encircling it's perimeter for the track rollers of the interchanger unit to follow and a carrier that rotates with the interchanger that keeps the track rollers aligned on the races and transfers the converted rotational motion to the output shaft by means of gears. The carrier also includes a mechanical means of absorbing the energy at the end of each stroke created by inertia as the speed (RPM's) of the engine increases, then releasing that energy back after the track rollers pass the upper and lower radiuses of the races, therefore helping facilitate the reciprocating motion of the piston, connecting rod and interchanger unit for the purpose of increasing the performance, service life and dependability of the engine by reducing stress to the track rollers, interchanger unit and races. The rotating assembly and geared crankshaft configuration is to convert the linear motion of the piston into a greater amount of rotational working power to the crankshaft utilizing an increased leverage angle for a much longer duration of the combustion stroke than with a standard automotive style connecting rod and crankshaft configuration while keeping the rest of the engines design and functions the same or close to the same as the well known and proven combustion engine technology of today.

BRIEF DESCRIPTION OF THE DRAWINGS

FIG. 14 is a view of the rotating carrier taken along 4-4 of FIG. 11, to show individual lettering of the tracks that the power transfer rollers and interchanger centering rollers ride on;

DETAILED DESCRIPTION OF THE INVENTION

Figure 1:
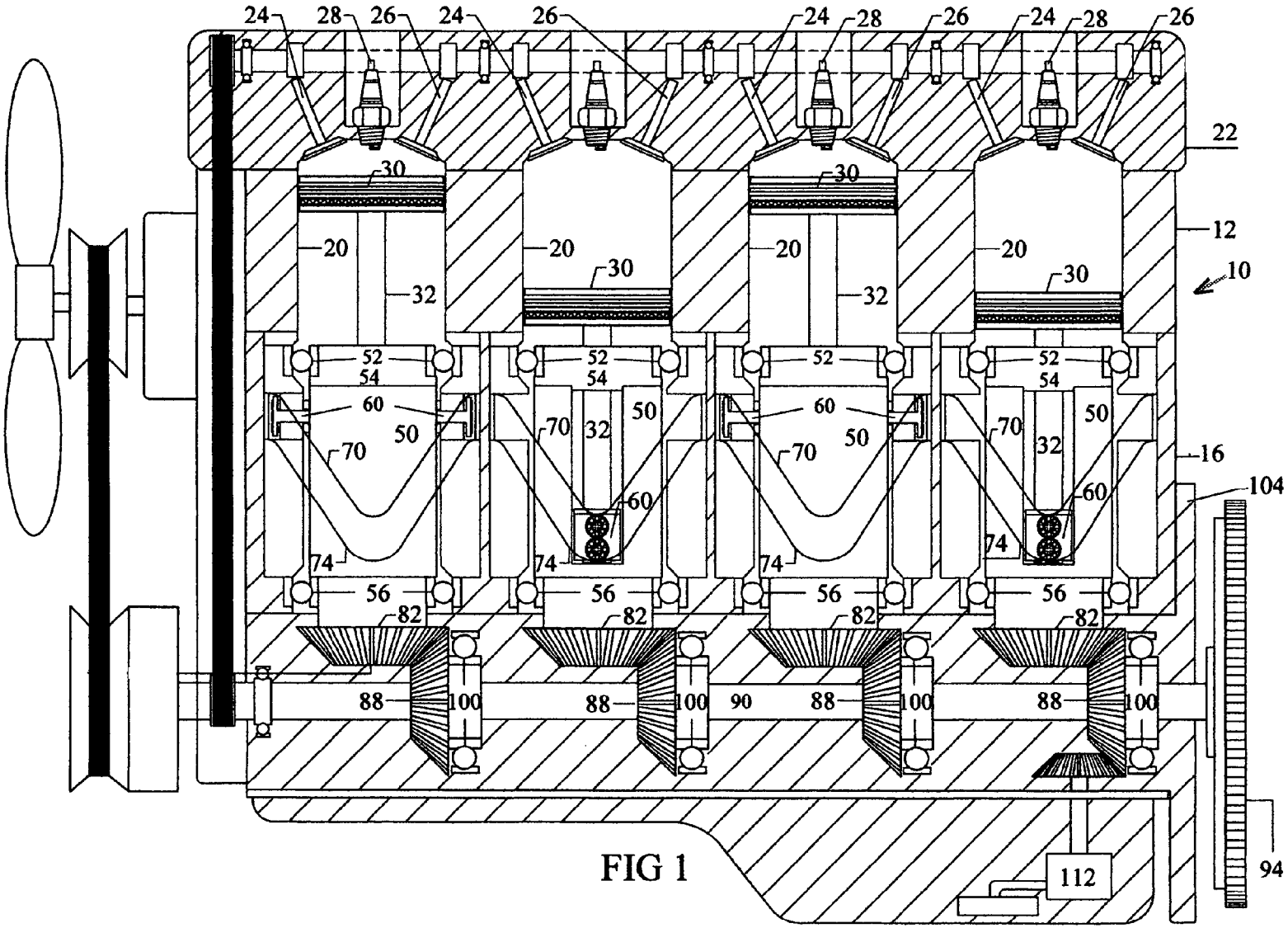
FIG. 1 is a cutaway side view of an engine of a four-cylinder internal combustion configuration with some parts deleted for clarity of illustration.

Referring to the drawings, the engine comprises a block 10, which is composed of a cylinder block 12, interchanger block 16, and crankcase 104, having bores defined by cylinders 20, cylinder head 22, intake means 24, ignition means 28, exhaust means 26, pistons 30, wave races 70 (upper) and 74 (lower), Interchanger units 60, rotating carriers 50, driver and driven gears 82 and 88, crankshaft 90, lubrication means 112 and various working and support bearings 52, 56 and 100.

Figure 4:
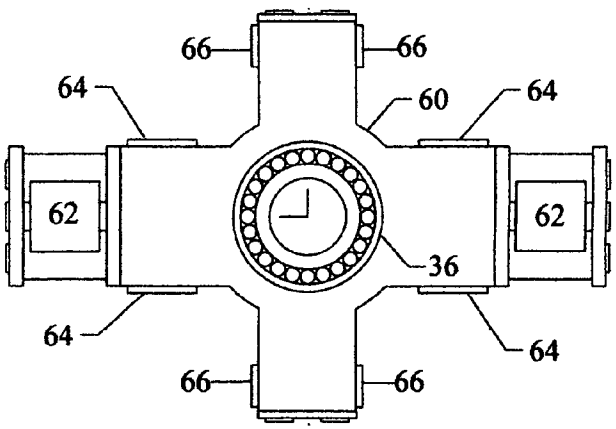
FIG. 4 is a top view of the interchanger unit.
Figure 7:
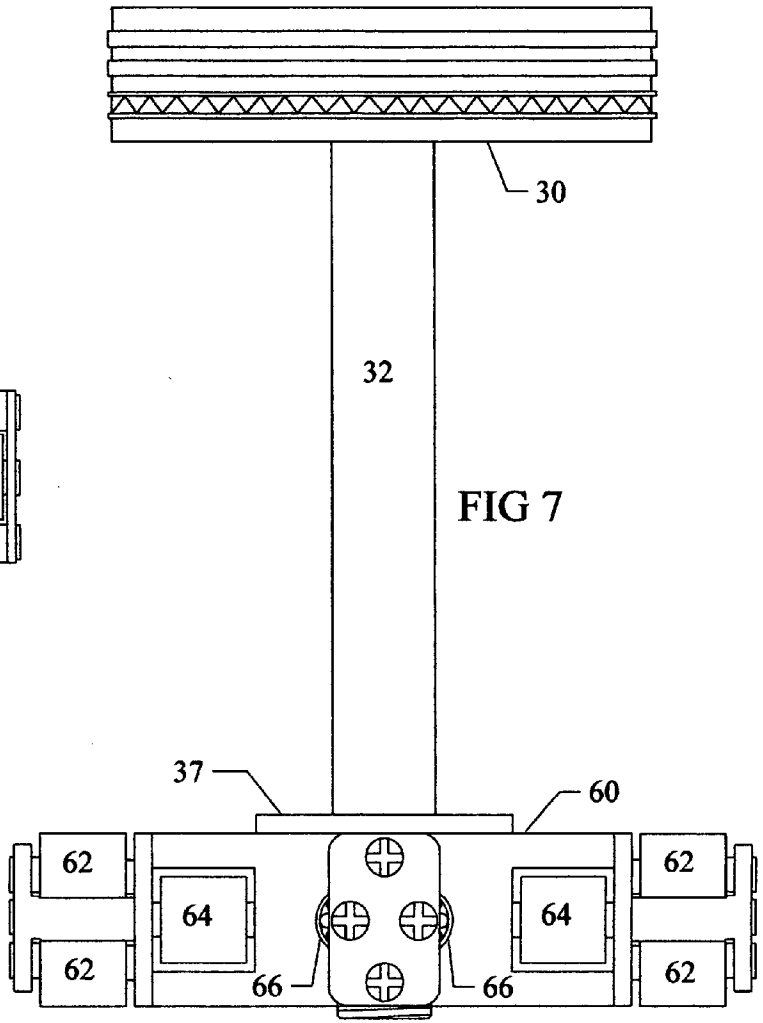
FIG. 7 is a side view of the interchanger unit taken along 5-5 of FIG. 4 shown attached to a connecting rod and piston.
Figure 5:
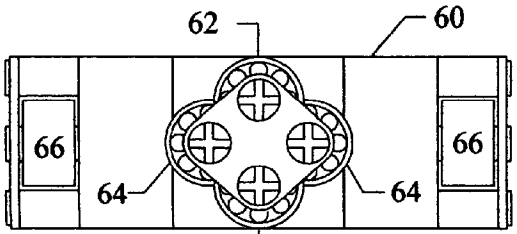
FIG. 5 is an end view of the interchanger unit taken along 4-4 of FIG. 4.
Figure 11:
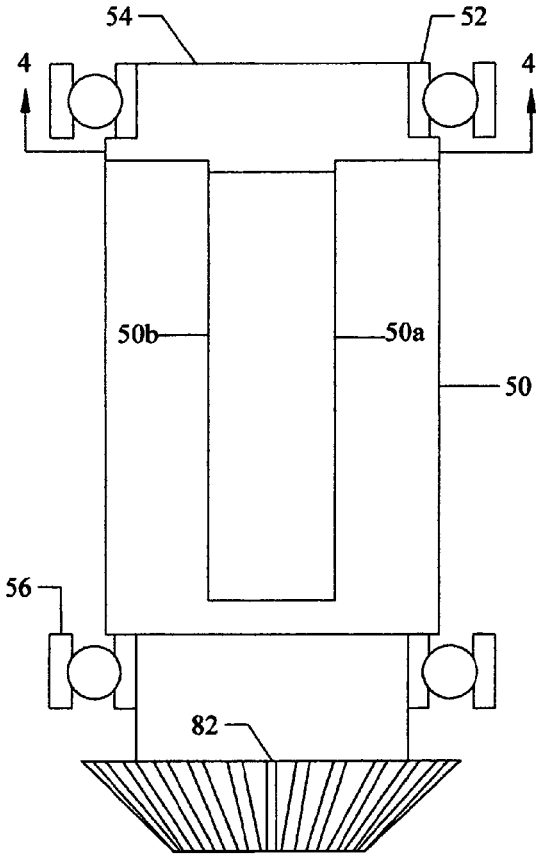
FIG. 11 is a side view of the rotating carrier unit assembled.
Figure 13:
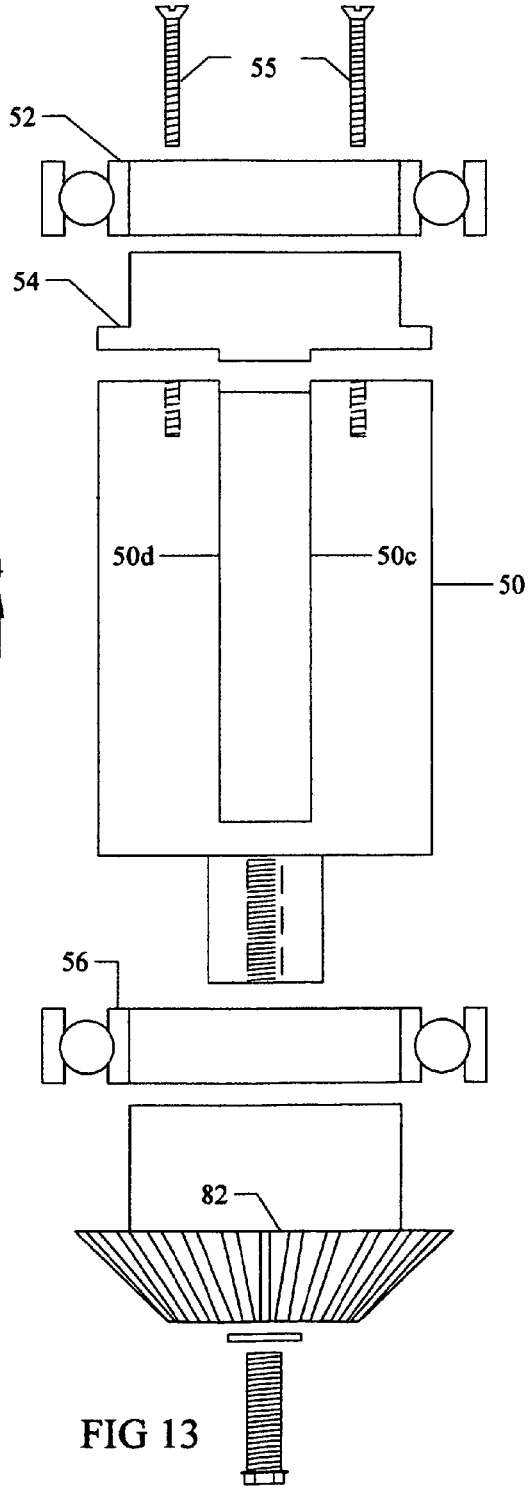
FIG. 13 is an exploded view of the rotating carrier taken along 3-3 of FIG. 11, to show all parts including the driver gear attached to it's lower end that transfers converted rotational motion to the crankshaft via a matching driven gear on the crankshaft.
Figure 14:
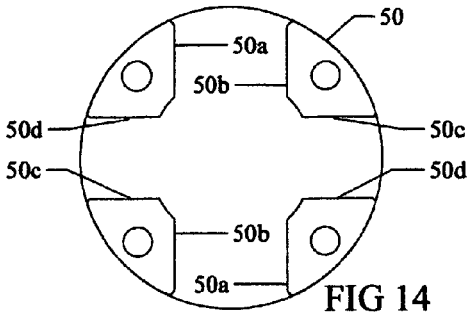
Figure 15:
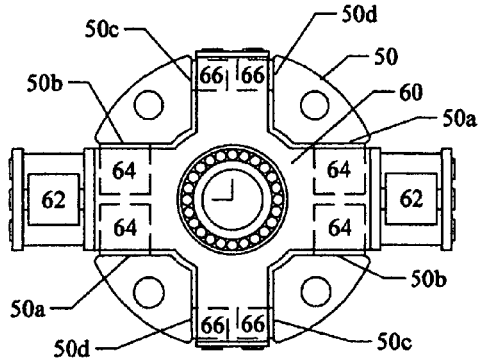
FIG. 15 is the same as FIG. 14, except rotated 90 degrees, with the interchanger sitting in it to show correct positioning.
Figure 16:
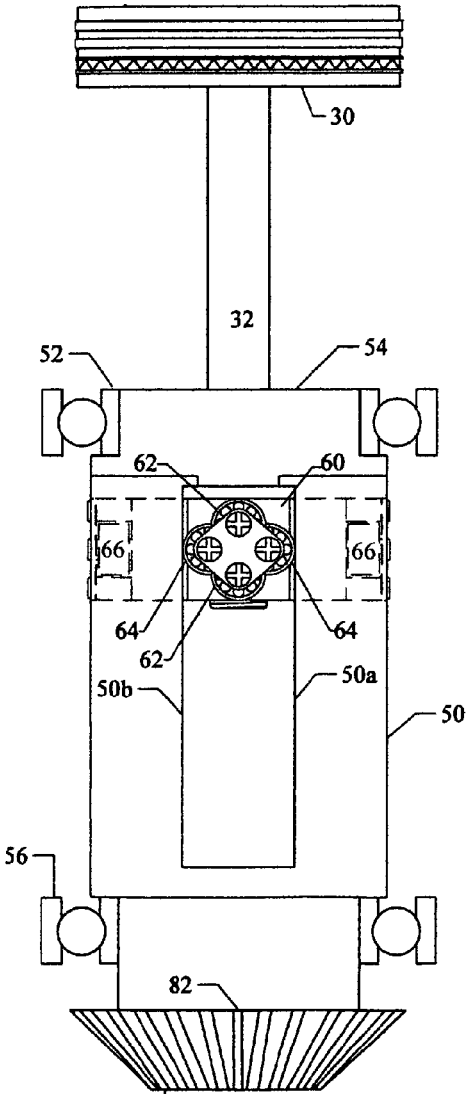
FIG. 16 is a view of the assembled rotating carrier with a piston, connecting rod and interchanger sitting in it to show correct position in an extended position.
Figure 17:
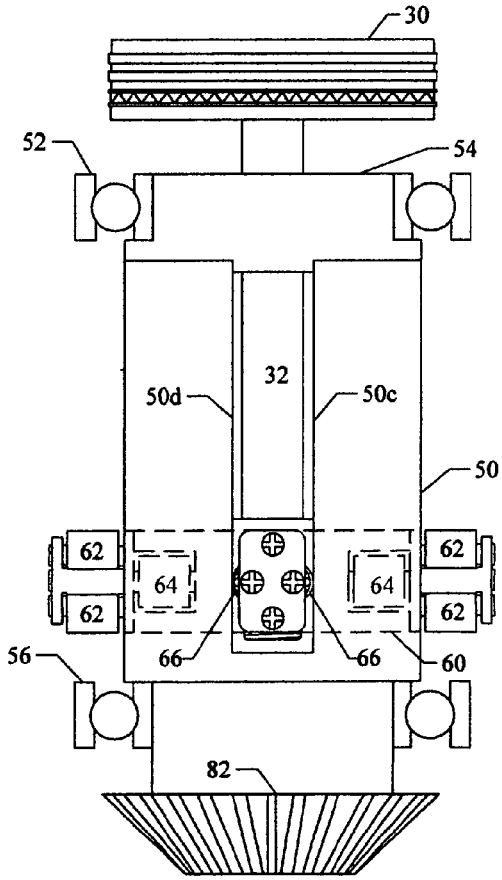
FIG. 17 is the same as FIG. 16 taken along 6-6 of FIG. 16 to show correct position of the piston, connecting rod and interchanger in a compressed position.
Figure 18:
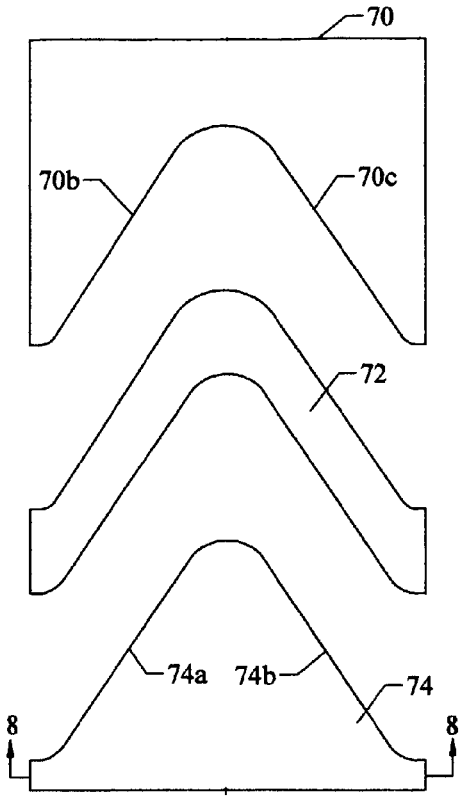
FIG. 18 is an exploded view of the upper and lower wave races showing the individually numbered slopes of the races and the spacer.
Figure 19:
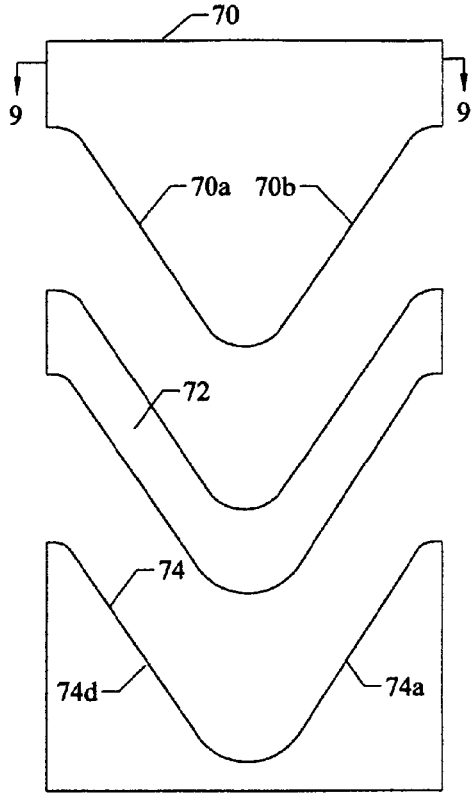
FIG. 19 is the same as FIG. 18 taken along 7-7 of FIG. 18.
Figure 20:
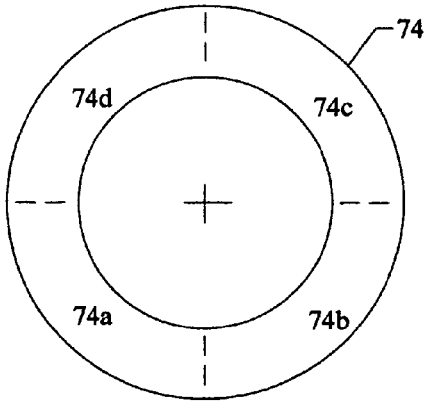
FIG. 20 is a view of the lower wave race as taken along 8-8 of FIG. 18.
Figure 23:
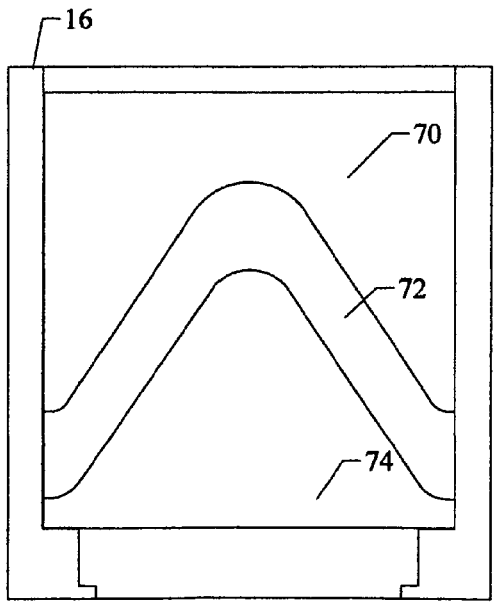
FIG. 23 is a view of the interchanger block, wave races and spacer assembled as a unit.
Figure 25:
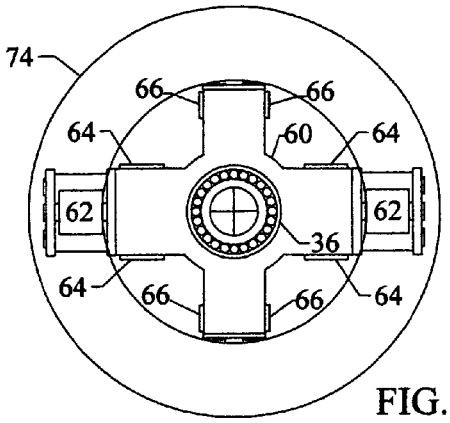
FIG. 25 is view of the lower wave race as taken along 8-8 of FIG. 18 with the interchanger sitting on it to show correct positioning.
Figure 27:
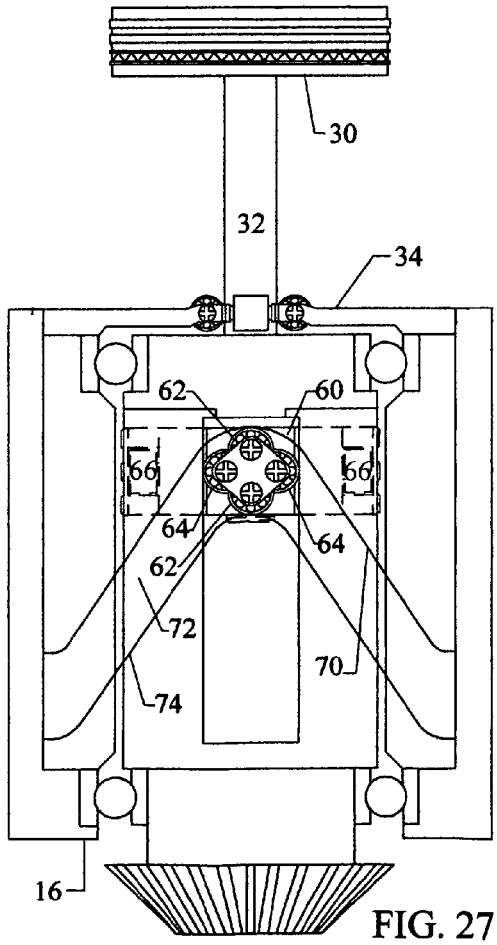
FIG. 27 is the same as FIG. 26 with the rotating carrier and connecting rod stabilizer also installed to show correct positioning and is shown as a complete rotating assembly.

In the particularly advantageous embodiment of the invention illustrated, the rotating assembly as shown in FIG. 27, is composed of three main components functioning together, an interchanger unit 60, as shown in FIGS. 4, 5, and 7, having track rollers 62, which ride between two wave shaped races 70 and 74 that are parts of a stationary mounted cylindrical unit as shown in FIG. 23. The third component is a rotating carrier unit 50, mounted on bearings 52 and 56, with the top bearing 52, mounted on a support 54, that also adds stability to the carrier, as shown in FIG. 11, in which the interchanger 60 rides up and down in to keep the interchanger 60, centered by means of centering rollers 66, riding on the carrier tracks 50*c* and 50*d* as seen in FIGS. 13, 14 and 15, to maintain correct orientation of the track rollers 62, on the races 70 and 74. The carrier 50, also transfers the converted rotational motion from the interchanger 60, by means of the power transfer rollers 64, riding on the carrier tracks 50*a* and 50*b* as shown in FIGS. 11, 14 and 15, to the output shaft (crankshaft) 90, via gears 82 and 88 as shown in FIGS. 1, 11, 13, 27 and 31 through 38, Referring to FIGS. 31 through 38, are illustrations of the engine through the four cycles of an Otto cycle or Diesel cycle engine from beginning to end starting with the piston 30, ready to begin the intake cycle, then continuing through the compression cycle, combustion cycle and ending with the exhaust cycle. In FIGS. 31 through 38 it shows the movement of the track rollers 62 as they traverse up and down the slopes 74*a*, 74*b*, 74*c*, 74*d* and 70*a*, 70*b*, 70*c*, 70*c* of the wave races 74 and 70, as also shown in FIGS. 18, 19, 20 and 21.

Figure 8:
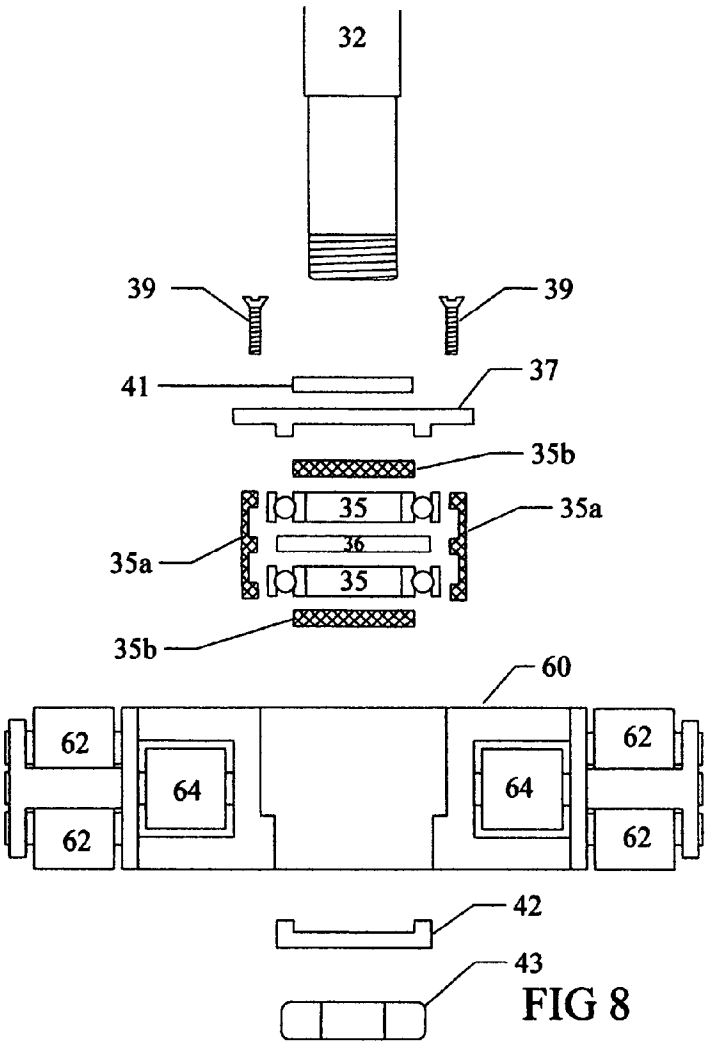
FIG. 8 is a an exploded view of all the parts included in fastening the interchanger to a connecting rod.
Figure 12:
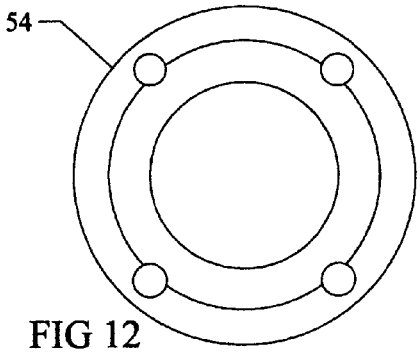
FIG. 12 is a view of the upper carrier bearing support as taken along 4-4 of FIG. 11.
Figure 21:
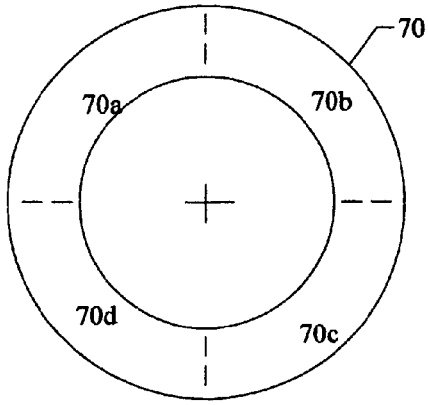
FIG. 21 is a view of the upper wave race as taken along 9-9 of FIG. 19.

The interchanger 60, is so named because it converts reciprocating motion into rotational motion during the combustion cycle and then converts rotational motion to reciprocating motion during the intake, compression and exhaust cycles. The conversion from reciprocating motion to rotational motion is accomplished during the combustion stroke when the rollers 62, are forced at the same time down the declining slopes 1*b* and 2*b*, as shown in FIG. 21, causing a downward spiraling motion. Because the faces of the slopes 2*b*, and 2*b* are of a 45 degree decline (after a short radius at the top), the downward pressure from the piston 30, is converted to rotational motion at a one to one ratio. This means that for every inch the piston 30, moves down, the interchanger will rotate an inch therefore converting the reciprocating motion of the piston 30, into rotational motion at a 90 degree angle to the axis of the interchanger and therefore achieve an optimal transfer of energy. The rotating carrier as seen in FIG. 12 then transfers the converted rotational motion to the crankshaft 90, through the driver and driven gears 82 and 88, when the power transfer rollers 64, and interchange centering rollers 66, as seen in FIGS. 6, 7 and 8, ride up and down the races 50*a*, 50*b*, 50*c* and 50*d*, of the carrier 50, while under the pressure created by the interchanger 60, as they follow the contours of the races 70 and 74.

The piston 30, is returned to the cylinder top (Top dead center) and through the remaining three strokes of the combustion cycle either by centrifugal force from the flywheel 94, as seen in FIG. 1, attached to the crankshaft 90, or the power from other pistons connected to the same crankshaft 90. A flywheel 94 is also used to ensure smooth rotation.

Figure 3:
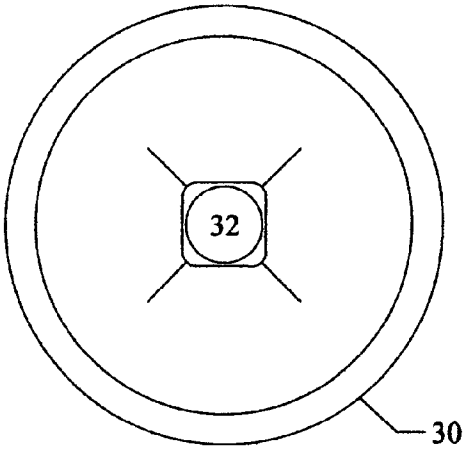
FIG. 3 is a view of a connecting rod and piston taken along 1-1 of FIG. 2.
Figure 2:
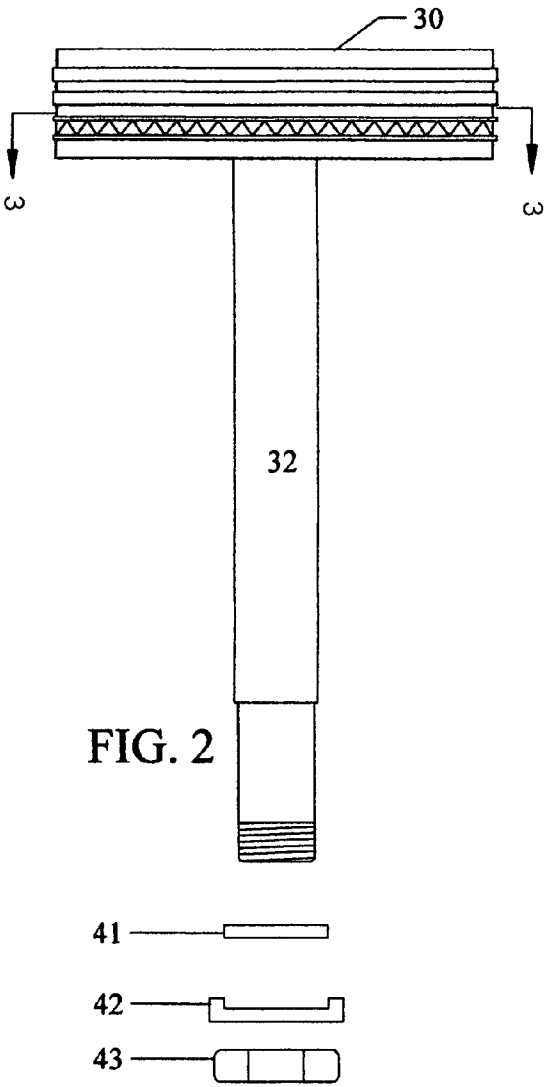
FIG. 2 is a view of a piston, connecting rod, retaining nut and washers. The connecting rod and piston are one solid piece or two pieces securely fastened together.
Figure 10:
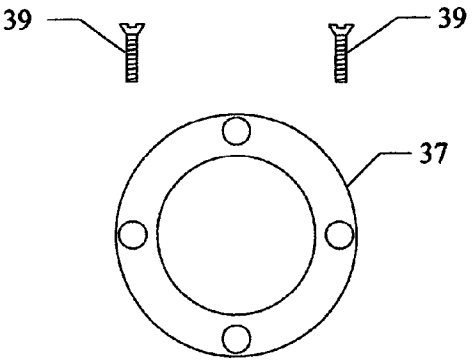
FIG. 10 is a view of the thrust-bearing retainer as taken along 3-3 of FIG. 9, and screws.
Figure 9:
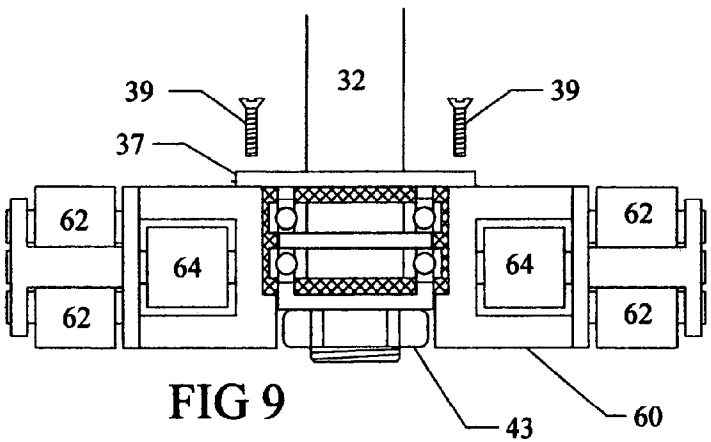
FIG. 9 is a cutaway view of the interchanger unit fastened to a connecting rod to show correct location of all parts as installed.
Figure 28:
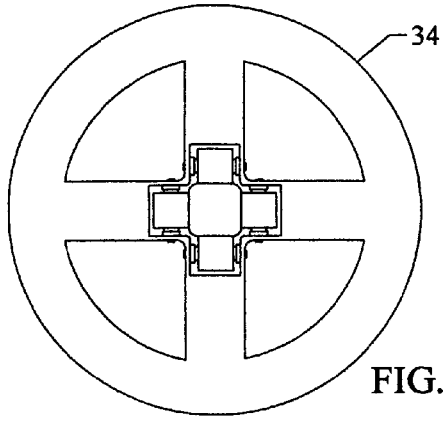
FIG. 28 is a view of the connecting rod stabilizer unit as taken along 9-9 of FIG. 27.
Figure 26:
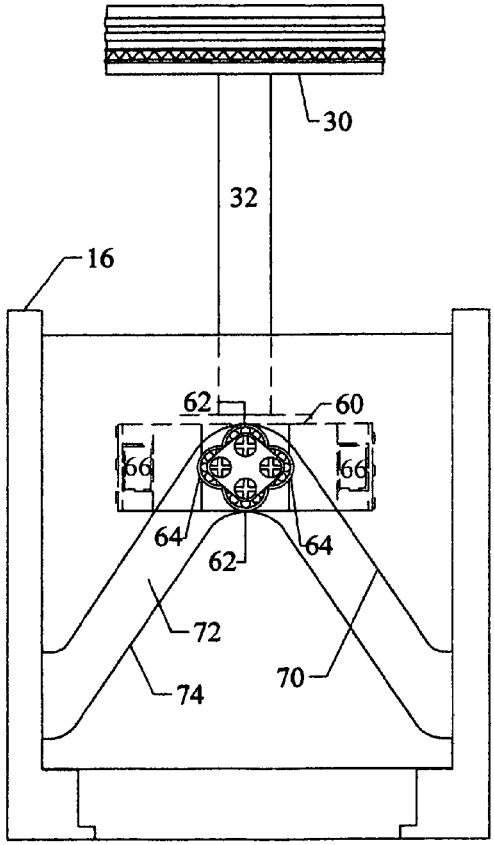
FIG. 26 is the same as FIG. 23 with the interchanger, piston and connecting rod extended to show correct positioning.

To help insure the performance and service life of the engine, the piston 30, is held from spinning inside the cylinder 20, by means of a stabilizer unit 34, as seen in FIGS. 27 and 28. The stabilizer unit 34, keeps the piston from spinning by means of four rollers that stay in contact with the four sides of the connecting rod 32, as shown in FIGS. 2 and 3. The piston 30, and connecting rod 32, are able to be restrained from spinning because they are attached to the interchanger 60, by means of thrust bearings 35, as seen in FIGS. 8 and 9. Also referring to FIGS. 2, 8, and 9, the retaining nut 43, and washers 41 and 42, thrust bearing retainer 37, and screws 39, as seen in FIGS. 9 and 10, also retain shock dampeners 35*a* and 35*b*, that help shield the thrust bearings 35, from shock created from combustion to the piston 30, or inertia during higher speeds of the engine as the track rollers 62, reach the top and bottom radiuses of the races 70 and 74

Figure 6:
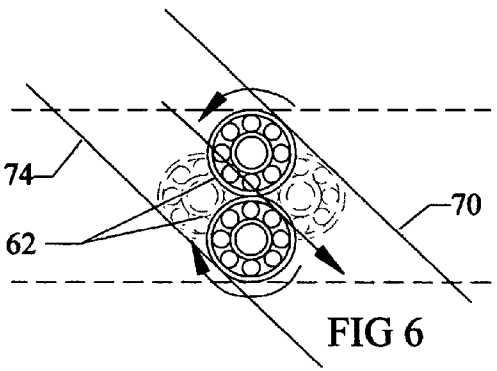
FIG. 6 is a view of the track rollers exposed to show them in contact with each other and direction of rotation as they ride between the races.
Figure 24:
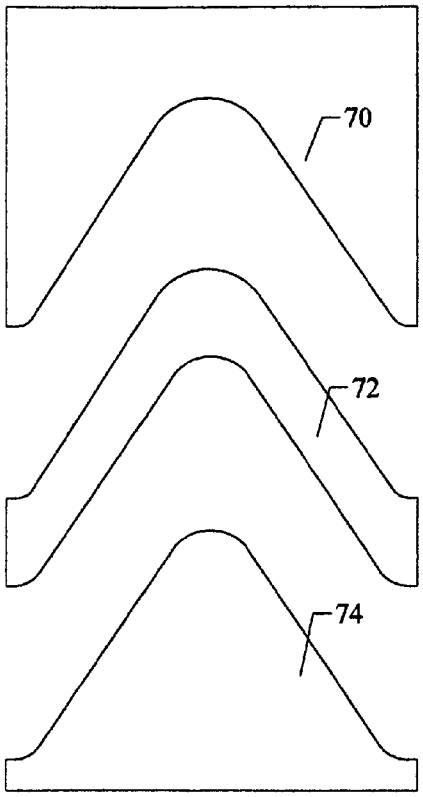
FIG. 24 is a view of the wave race spacer as taken along 8-8 of FIG. 18.
Figure 24:
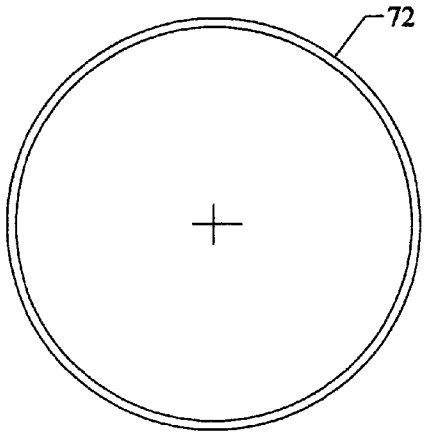
Figure 22:
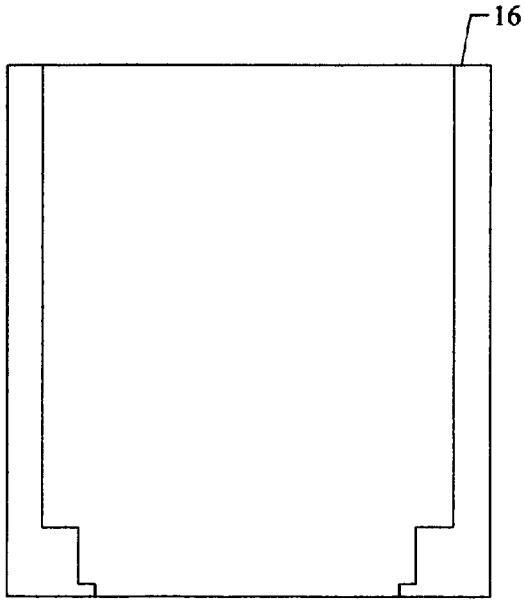
FIG. 22 is an exploded view of the interchanger block, wave races and spacer.

Referring to FIG. 6, the track rollers are mounted in such a manner as to keep them in contact with each other. This contact is for the purpose of keeping them always spinning at the correct speed and direction as they ride on the races 70 and 74. The spacer 72, as seen in FIGS. 23 and 24 keeps the races 70 and 74, at the correct distance from each other to maintain close tolerance to the track rollers 62, but as the track rollers 62, follow the contours of the races 70 and 74, contact will fluctuate between the races, so to keep the track rollers 62, from skidding on the races or have to change in rotational direction, they are always kept spinning the correct direction and speed by always being in contact with the other roller. The track rollers 62, always being in contact with each other also allows the load subjected to one roller to be shared by both, therefore reducing the load that any one roller will have to bear on its own which will extend the service life of both rollers. The track rollers 62, and races 70 and 74 may be substituted for other means of accomplishing the same functions such as magnets, hydraulics, pressurized air or any other means that will facilitate a similar type working relationship that will yield the same results, The rotating assembly may also be configured to where the interchanger and carrier are mounted stationary with the races rotating around them or any other configuration that yields the same results.

Figure 29:
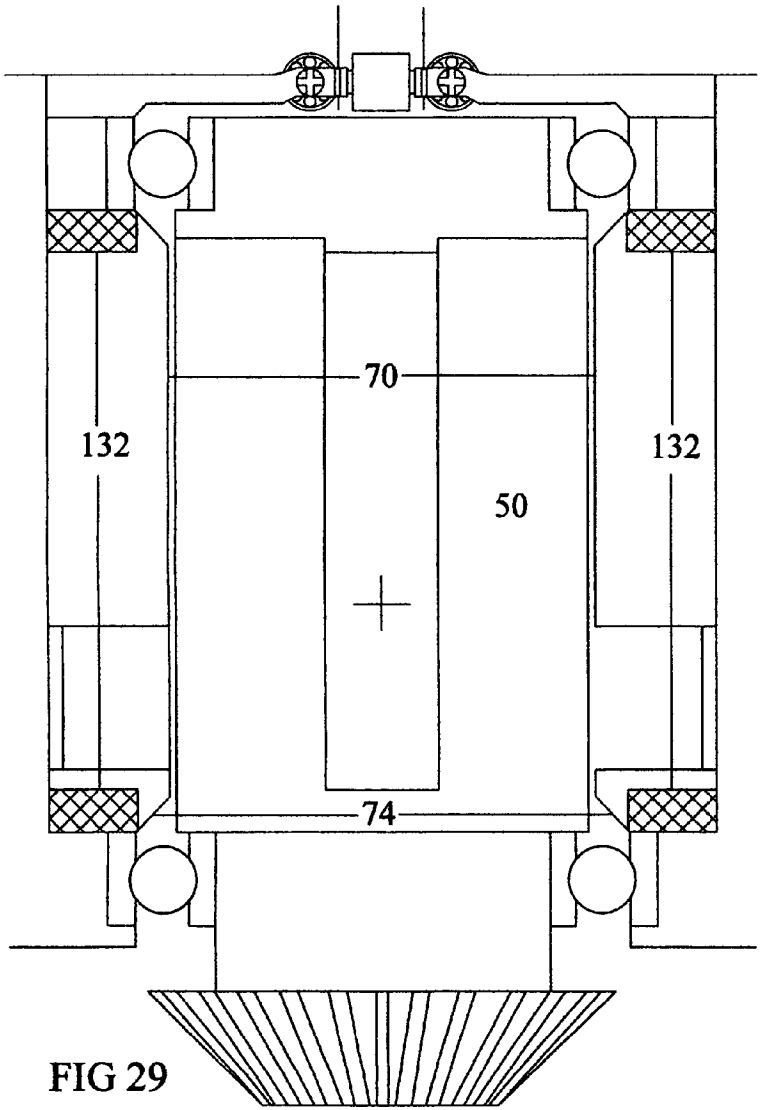
FIG. 29 is a view of a rotating assembly with some parts deleted for clarity of illustration, showing the wave races mounted on shock absorbing pads.
Figures 31, 32, 33, 34:
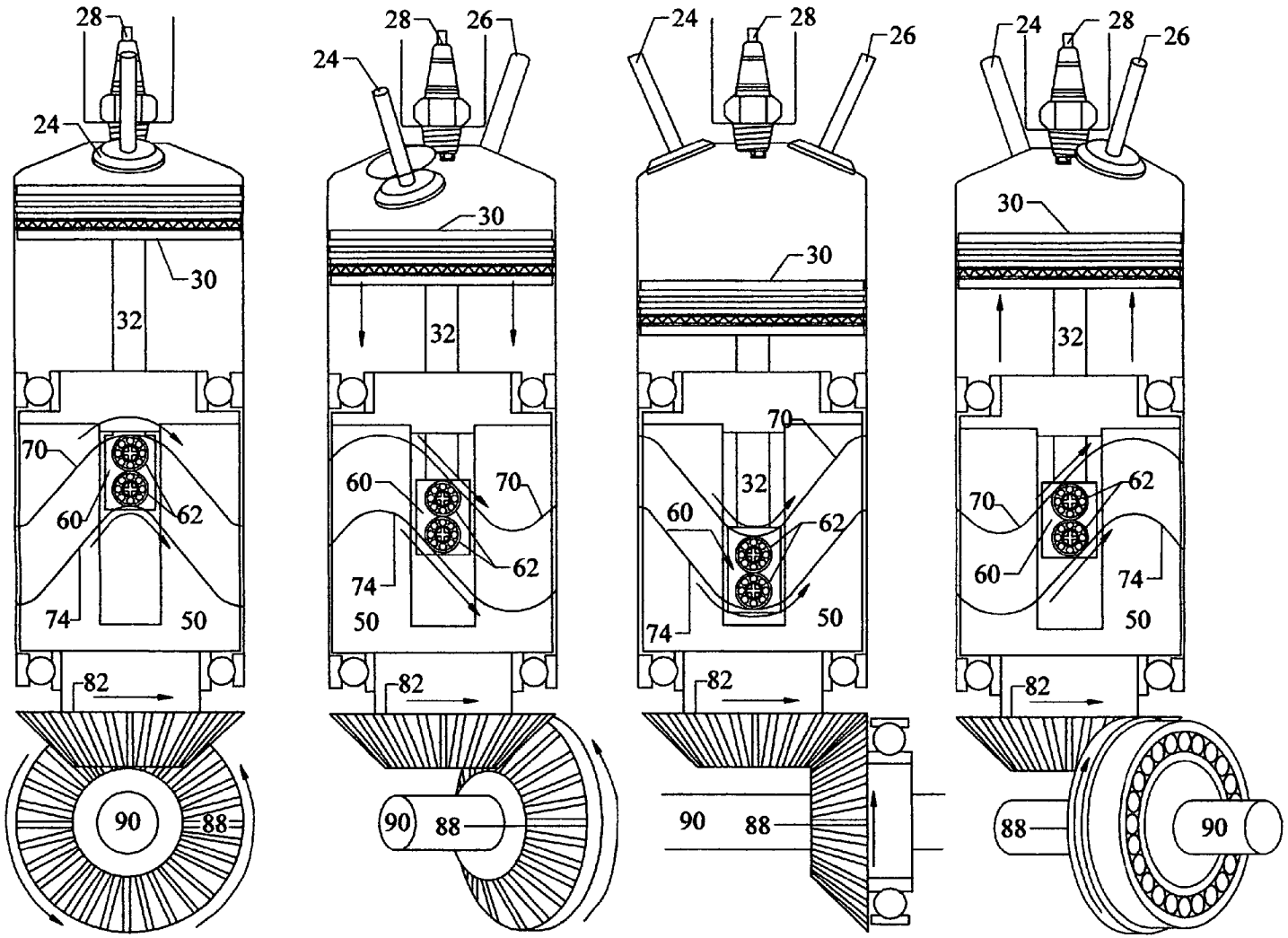
FIG. 31 is a view of a complete rotating assembly as installed in an engine as taken along 2-2 of FIG. 1 with some parts deleted for clarity of illustration, the piston and valves are shown ready to start an intake stroke.
FIG. 32 is the same as FIG. 31 except rotated one eighth of a turn to the right with the intake valve open, the piston halfway into an intake stroke and the interchanger unit rotating counter clockwise as viewed from above.
FIG. 33 is the same as FIG. 32 except rotated one eighth of a turn to the right with the intake valve closed and the piston at the end of the intake stroke and ready to start the compression stroke.
FIG. 34 is the same as FIG. 33 except rotated one eighth of a turn to the right with the piston halfway into the compression stroke.
Figures 35, 36, 37, 38:
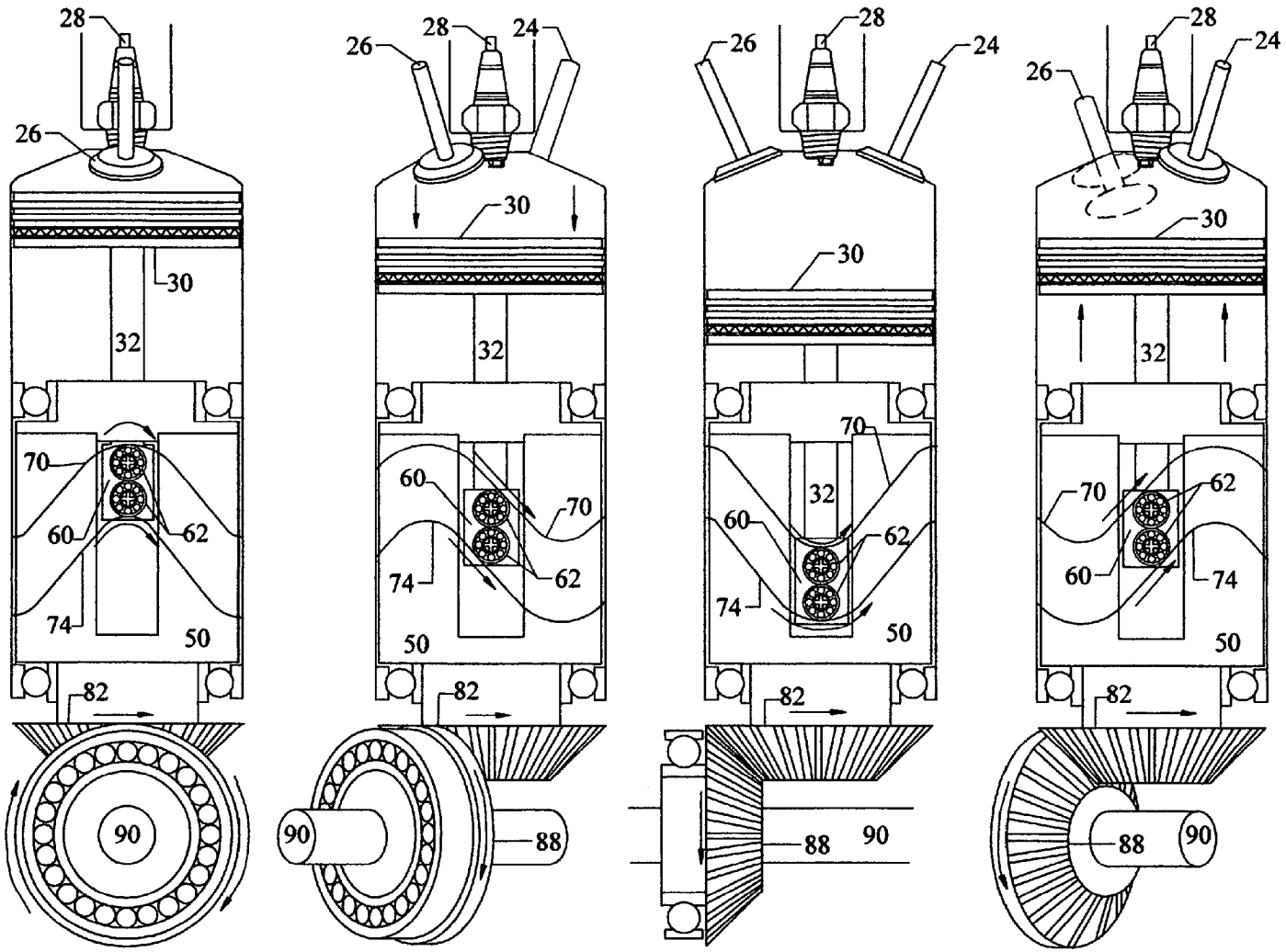
FIG. 35 is the same as FIG. 34 except rotated one eighth of a turn to the right with the piston at the end of the compression stroke and ready to start the combustion stroke.
FIG. 36 is the same as FIG. 35 except rotated one eighth of a turn to the right with the piston halfway into the compression stroke.
FIG. 37 is the same as FIG. 36 except rotated one eighth of a turn to the right with the piston at the end of the combustion stroke and ready to start the exhaust stroke.
FIG. 38 is the same as FIG. 37 except rotated one eighth of a turn to the right with the exhaust valve open and the piston halfway into the exhaust stroke. The next position for the piston to be in will be the same as FIG. 31 ready to start the four cycles over.

Referring to FIG. 29, the races 70 and 74, are shown mounted on shock absorbing dampeners 132. These dampeners are installed to absorb and release shock created from combustion to the piston 30, or inertia during higher speeds of the engine as the track rollers 62, reach the top and bottom radiuses of the races 70 and 74. These dampeners 132, may be made of high density rubber or polyurethane type materials that offer a higher load-bearing capacity than rubber with more resistance to oils and chemicals found on the inside of an engine. This same rubber or polyurethane type materials will also be used in the shock dampeners 35*a* and 35*b* as seen in FIG. 8. Springs, conical washers, fluid, air or any other means may be substituted for the rubber or polyurethane dampeners 35*a*, 35*b* and 132.

Figure 30:
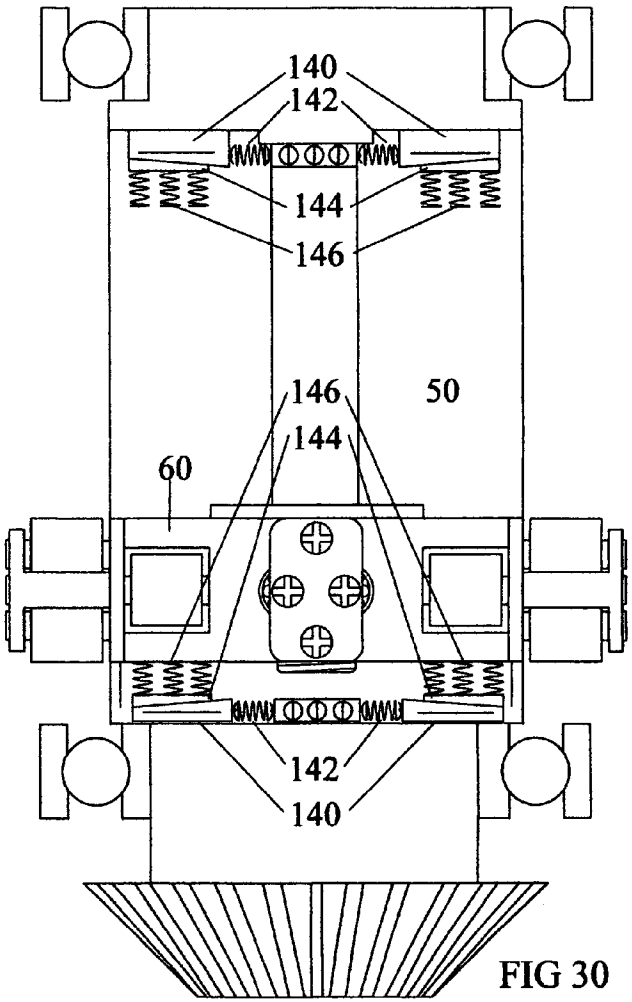
FIG. 30 is a view of a rotating carrier and interchanger unit with some parts deleted for clarity of illustration, showing a reciprocator system installed in the carrier.

Referring to FIG. 30, a reciprocator system is shown installed in the carrier 50, which is operated by centrifugal force. As the speed (RPM's) of the engine increases, the inclined centrifugal weights 140, overcome the resistance of the centrifugal weight springs 142, allowing the weights to move outward from the center of the carrier 50. The resulting movement causes the reciprocator spring inclines 144, to move up creating more pressure on the reciprocator springs 146, therefore creating a speed sensitive mechanical means of absorbing the increasing amount of energy at the end of each stroke created by inertia as the speed (RPM's) of the engine increases, then releasing that energy back after the track rollers 62, pass the upper and lower radiuses of the races 70 and 74, therefore helping facilitate the reciprocating motion of the piston 30, connecting rod 32, and interchanger unit 60, for the purpose of increasing the performance, service life and dependability of the engine by reducing stress to the track rollers 62, interchanger unit 60, and races 70 and 74. This mechanical reciprocator system may be substituted for a different type of system that utilizes pressurized fluids, compressed air, magnets or other means to accomplish the same speed sensitive absorbing and releasing of energy process.

The materials to be used in the overall construction of the engine is expected to be aluminum, steel, rubber, plastics, automotive type gaskets and most any other materials commonly used in the manufacture of engines. Some exotic materials such as ceramics or specialty metals may be used in key areas such as the combustion chambers, rotating assemblies etc. The materials to be used in the rotating assembly will generally be of high-grade steel or similar materials because they are subjected to high pressures and impact. A softer surface may be applied to the tracks 70 and 74, such as high-density rubber or polyurethane type materials to help reduce shock loads to the track rollers 62.

Many other parts and functions of this engine and overall construction were not discussed in detail or discussed very little in this description due to the nature of many parts, designs, functions and construction of this engine do not differ or differ very little from designs, and technology already well known and used for many years and therefore considered common knowledge and standard practice in the field of reciprocating engines. Some of these functions include but are not limited to; fuel delivery system, lubrication means, ignition system, cooling system, compression ratios, combustion chamber sealing, high performance modifications, supercharging, turbocharging, previous designs, manufacturing procedures, materials of manufacture, maintenance, means for attaching this engine to machinery or transmission etc. By remaining close to the current engine designs, materials of manufacture and manufacturing procedures of today allows this engine to be reproduced more readily and also makes it much easier for consumers to understand, maintain and operate by being nearly the same as the engines they are already familiar with.

The invention has been described in detail with particular reference to the embodiments thereof, but it will be understood that variations and modifications can be affected within the spirit and scope of the invention.

The embodiments of the invention in which an exclusive property or privilege is claimed are defined as follows:

1. A reciprocating engine, comprising:

a block forming a housing for a piston operating in a cylinder; and an assembly that converts the reciprocating motion of the piston into rotational motion, wherein the assembly includes:

an interchanger unit having at least two ends with a pair of track rollers mounted at at least one end, the interchanger unit attached to a connecting rod by bearings allowing the interchanger unit to rotate relative to the connecting rod;

a stationary cylindrical unit having opposing wave shaped races encircling the cylindrical unit's inside perimeter with slopes of about 45 degrees for the pair of track rollers to follow and to facilitate an up and down spiraling motion of the interchanger unit thereby converting the reciprocating motion of the interchanger unit into rotational motion while allowing the interchanger unit to continue rotating in the same direction; and a rotating carrier supported by bearings that supports the interchanger unit while rotating with the interchanger unit, keeps the pair of track rollers aligned and transfers the converted rotational motion to an output shaft.

2. The reciprocating engine of claim 1, wherein the wave shaped races include more than one wavelength with at least one wavelength having a different amplitude.

3. The reciprocating engine of claim 1, further comprising a speed sensitive mechanism configured to move the wave races relative to the cylinder to adjust the compression ratio of the engine.

4. The reciprocating engine of claim 1, wherein the pair of track rollers are in constant contact with each other to allow contact with both races at the same time and thereby allow each roller to always be turning the correct direction on its corresponding race.

5. The reciprocating engine of claim 1, further comprising a system that absorbs energy from the interchanger unit when the pair of track rollers reach the radiuses of the wave shaped races, and then release that energy back as the pair of track rollers passes the radiuses of the wave shaped races.

* * * * *